US009702196B2

(12) United States Patent
Adams

(10) Patent No.: US 9,702,196 B2
(45) Date of Patent: Jul. 11, 2017

(54) CORING TOOL INCLUDING CORE BIT AND DRILLING PLUG WITH ALIGNMENT AND TORQUE TRANSMISSION APPARATUS AND RELATED METHODS

(71) Applicant: Baker Hughes Incorporated, Houston, TX (US)

(72) Inventor: Nathaniel R. Adams, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 686 days.

(21) Appl. No.: 14/020,296

(22) Filed: Sep. 6, 2013

(65) Prior Publication Data

US 2015/0068809 A1 Mar. 12, 2015

(51) Int. Cl.

| | |
|---|---|
| ***E21B 10/02*** | (2006.01) |
| ***E21B 23/00*** | (2006.01) |
| ***E21B 25/02*** | (2006.01) |
| ***E21B 25/16*** | (2006.01) |

(52) U.S. Cl.

CPC ..... *E21B 10/02* (2013.01); *E21B 23/004* (2013.01); *E21B 25/02* (2013.01); *E21B 25/16* (2013.01)

(58) Field of Classification Search

CPC ..... E21B 10/02; E21B 10/62; E21B 10/64; E21B 23/004; E21B 25/02

See application file for complete search history.

(56) References Cited

U.S. PATENT DOCUMENTS

| | | | | |
|---|---|---|---|---|
| 2,543,861 | A * | 3/1951 | Mader | E21B 10/04 175/385 |
| 2,708,105 | A * | 5/1955 | Williams, Jr. | E21B 10/04 175/400 |
| 4,466,497 | A | 8/1984 | Soinski et al. | |
| 5,351,765 | A * | 10/1994 | Ormsby | E21B 25/02 175/246 |
| 5,568,838 | A | 10/1996 | Struthers et al. | |
| 7,520,343 | B2 * | 4/2009 | Hughes | E21B 10/64 175/171 |
| 8,016,053 | B2 * | 9/2011 | Menezes | E21B 10/62 175/262 |
| 2005/0167158 | A1 * | 8/2005 | Fanuel | E21B 7/061 175/61 |

(Continued)

OTHER PUBLICATIONS

National Oilwell Varco, Corion Express® Premium Wireline Coring, http://www.nov.com/Downhole/Coring_Services/Corion_Express.aspx, accessed Aug. 12, 2013, 2 pages.

*Primary Examiner* — Shane Bomar
(74) *Attorney, Agent, or Firm* — TraskBritt

(57) ABSTRACT

A coring tool may comprise a core bit, and the core bit may comprise at least one cutting structure extending from adjacent an inner bore of the core bit to an outer gage of the core bit. A drill plug may be configured to close the inner bore of the core bit, and the drill plug may comprise at least one cutting structure. An indexing device may be disposed between the drill plug and the core bit. The indexing device may be configured to maintain a predetermined angular relationship between the core bit and the drill plug. The at least one cutting structure of the core bit and the at least one cutting structure of the drill plug may form a substantially continuous cutting structure at the predetermined angular relationship. Related methods of drilling with a coring tool.

15 Claims, 6 Drawing Sheets

(56) References Cited

U.S. PATENT DOCUMENTS

2012/0205163 A1* 8/2012 Azar ..... E21B 10/26
175/428
2012/0261130 A1* 10/2012 Linn ..... E21B 23/002
166/313
2012/0273275 A1* 11/2012 Broussard, Jr. ..... E21B 10/04
175/57

* cited by examiner

CORING TOOL INCLUDING CORE BIT AND DRILLING PLUG WITH ALIGNMENT AND TORQUE TRANSMISSION APPARATUS AND RELATED METHODS

FIELD

The disclosure relates generally to coring tools for obtaining core samples of earth formations. More specifically, disclosed embodiments relate to coring tools including core bits and drilling plugs designed for use with the core bits during non-coring drilling using the coring tools. The disclosure also includes methods of using such coring tools.

BACKGROUND

When seeking information regarding the characteristics of an earth formation, such as, for example, the hydrocarbon content in the formation, a core sample may be obtained from the earth formation. The core sample may then be analyzed to determine the characteristics of the earth formation. Core samples may be obtained using coring tools. Coring tools conventionally include a core bit, which may include an inner bore and a cutting structure surrounding the inner bore. As the coring tool is driven into an earth formation, typically at the bottom of a previously formed borehole, the core bit may remove earth material around a core sample, which is received into the inner bore. A receptacle may be connected to the core bit, and may extend longitudinally above the core bit. The core sample may be received into the receptacle, and may be retained in the receptacle by a core catcher to keep the core sample within the receptacle as the core bit is withdrawn from the borehole.

In many cases, it may be desirable to alternate between coring operations and conventional drilling operations without tripping (i.e., removing) the drill string from the borehole. Accordingly, coring tools have been developed wherein the receptacle may be removed from the core bit by a wireline device, and a corresponding plug may be lowered by a wireline device and positioned concentrically within the inner bore of the core bit so as to plug the inner bore while the core bit is used to drill through the formation without coring. The corresponding plug may feature cutting structures positioned to engage and degrade the formation. The assembled core bit and plug may engage the formation and advance through the formation in a manner similar to a conventional drilling bit.

BRIEF SUMMARY

A coring tool may comprise a core bit comprising at least one cutting structure extending from adjacent an inner bore of the core bit to an outer gage of the core bit. A drill plug may be configured to close the inner bore of the core bit, and the drill plug may comprise at least one cutting structure. An indexing device may be disposed between the drill plug and the core bit. The indexing device may be configured to maintain a predetermined angular relationship between the core bit and the drill plug. The at least one cutting structure of the core bit and the at least one cutting structure of the drill plug may form a substantially continuous cutting structure at the predetermined angular relationship.

A coring tool may comprise a core bit with an inner bore extending longitudinally through a body of the core bit, and a coupling member configured for attachment of the coring tool to a drill string. A drill plug may be sized and configured to be inserted into the inner bore of the core bit. An indexing device configured to maintain a predetermined angular relationship between the core bit and the drill plug may be disposed between the core bit and the drill plug and located longitudinally along the coring tool at a location distal to the coupling member of the coring tool.

A method of drilling with a coring tool may comprise removing a core sample receptacle from an inner bore of a core bit, inserting a drill plug into the inner bore of the core bit, rotating the drill plug relative to the core bit to reach a predetermined angular relationship, rotationally locking the drill plug relative to the core bit at the predetermined angular relationship, and drilling through a formation with the core bit and drill plug.

BRIEF DESCRIPTION OF THE DRAWINGS

While the disclosure concludes with claims particularly pointing out and distinctly claiming specific embodiments, various features and advantages of embodiments of the disclosure may be more readily ascertained from the following description when read in conjunction with the accompanying drawings, in which:

DETAILED DESCRIPTION

The illustrations presented herein are not meant to be actual views of any particular coring tool or component thereof, but are merely idealized representations employed to describe illustrative embodiments. Thus, the drawings are not necessarily to scale.

Disclosed embodiments relate generally to coring tools including core bits with corresponding drill plugs, the core bits and drill plugs configured for improved drilling efficiency, including increased rate-of-penetration (ROP) and enhanced cleaning. More specifically, disclosed are embodiments of core bits and drill plugs featuring complementary cutting structures and indexing devices that maintain a predetermined angular orientation between the core bit and the corresponding drill plug during drilling.

Figure 1:
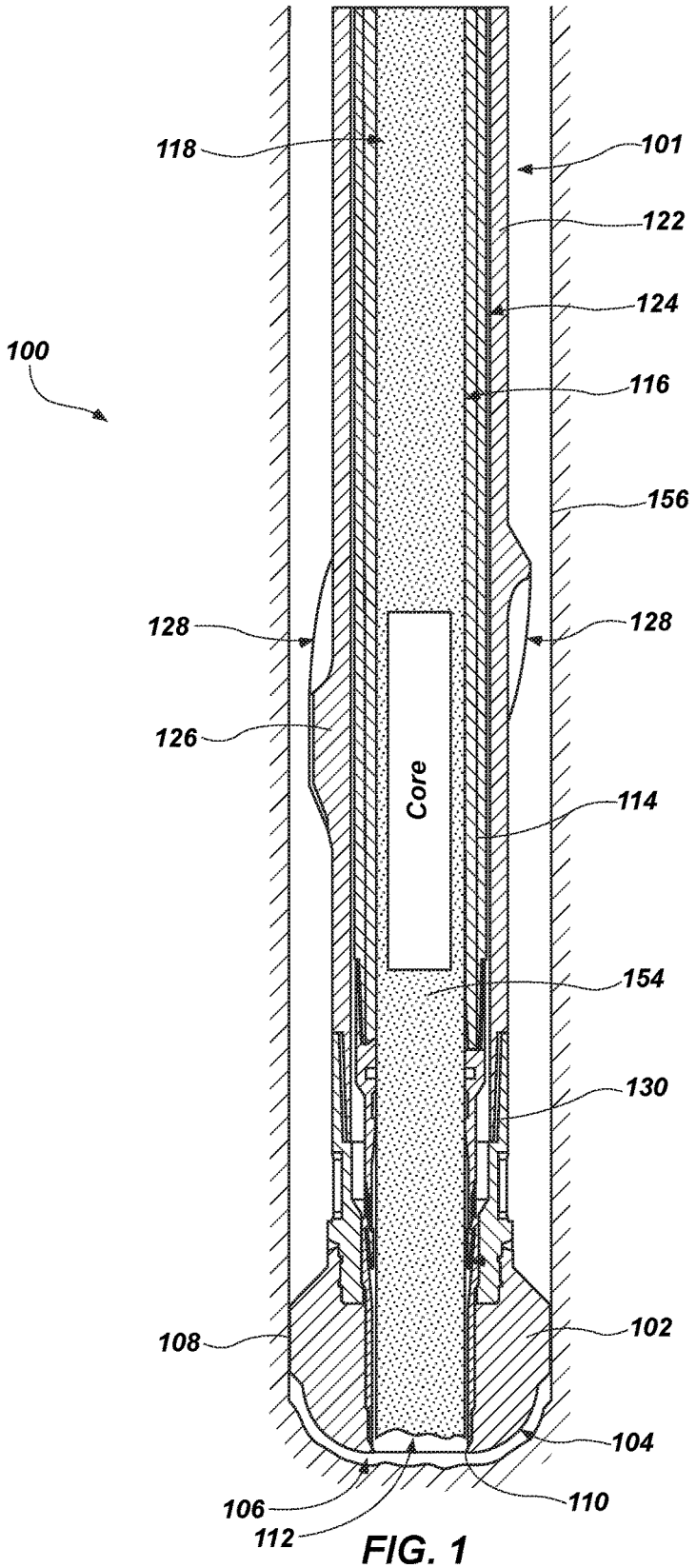
FIG. 1 is a cross-sectional view of a coring tool according to an embodiment of the present disclosure.

Referring to FIG. 1, a cross-sectional view of a coring tool 100 is shown. The coring tool 100 includes a core bit 102 configured to be positioned at the bottom of a drill string 101. The core bit 102 may include a cutting structure 104 distributed over a face 106 of the core bit 102. The cutting structure 104 may be configured to cut into and remove material from an underlying earth formation. The core bit 102 may include, for example, an outer gage 108 at a radially outermost position on the core bit 102. The cutting structure 104 may further include an inner surface 110 located radially inward from the outer gage 108. The inner surface 110 may define a maximum diameter of a core sample 154 to be cut using the core bit 102. The inner surface 110 may also define a central opening 112 extending through the core bit 102. Thus, the cutting structure 104 may surround the central opening 112. The central opening 112 may be configured to receive a core sample 154 as the cutting structure 104 removes material surrounding the core sample 154, such that the core sample 154 extends through the core bit 102 as the core bit 102 advances into the earth formation. The core bit 102 may be formed from a material suitable for use in a downhole environment, such as, for example, cemented tungsten carbide or steel.

The coring tool 100 may further include a receptacle 114, often referred to in the art as an "inner barrel," configured to receive a core sample 154 at least partially within the receptacle 114. The receptacle 114 may be connected to the core bit 102. For example, the receptacle 114 may be located partially within the central opening 112 with a lower end of the receptacle 114 being located adjacent to the inner surface 110 of the core bit 102. As another example, the receptacle 114 may be located longitudinally above the core bit 102. The receptacle 114 may be rotatable relative to the core bit 102, such that the receptacle 114 may remain rotationally stationary as it receives a coring sample while the core bit 102 rotates to cut the coring sample. The receptacle 114 may be generally tube-shaped and may include an inner surface 116 defining a bore 118 extending at least partially through the receptacle 114. The bore 118 may be sized and configured to receive a core sample 154 formed using the core bit 102 longitudinally (i.e., in a direction parallel to a direction in which the coring tool 100 is advanced when procuring a core sample 154) within the bore 118. The receptacle 114, and particularly the bore 118 extending through the receptacle 114, may extend for at least as long as a desired longitudinal length of a core sample 154 to be analyzed. In some embodiments, the receptacle 114 may be rotatable with respect to the drill string 101 such that rotation of the drill string 101 does not necessarily produce corresponding rotation of the receptacle 114. The receptacle 114 may be formed from a material suitable for use in a downhole environment, such as, for example, aluminum or steel alloys.

The coring tool 100 may include an outer barrel 122 connected to the core bit 102. The outer barrel 122 may comprise, for example, a generally tubular member, a lower end of which may be attached to the core bit 102. The outer barrel 122 may be connected to the remainder of the drill string 101 and may transfer loads (e.g., weight-on-bit (WOB) and torque) to the core bit 102 to drive the core bit 102 into an underlying earth formation. The receptacle 114 may be located within the outer barrel 122, and a flow path 124 may be defined between the receptacle 114 and the outer barrel 122 to enable drilling fluid to be pumped to the core bit 102 (e.g., to nozzles (not depicted) on the core bit 102 or simply out the central opening 112 proximate the inner surface 110), which may serve to remove cuttings produced while coring.

The outer barrel 122 may include a stabilizer 126 configured to stabilize the core bit 102 as it is driven into an underlying earth formation in some embodiments. In other embodiments, one or more stabilizers may be connected to the coring tool 100 (e.g., instead of, or in addition to, the stabilizer 126 incorporated into the coring tool 100 itself). The stabilizer 126 may include blades 128 extending radially outward from a remainder of the outer barrel 122. The blades 128 may contact and ride against walls of a borehole to stabilize the core bit 102 as it is advanced (e.g., driven linearly or driven linearly and rotationally). The blades 128 may be fixed in position in some embodiments. In other embodiments, the blades 128 may be extendable to a radially outermost position in which they contact and ride against the borehole wall and retractable to a radially innermost position in which they do not contact the borehole wall. The stabilizer 126 may be located longitudinally adjacent to the core bit 102 (i.e., there may not be any radially protruding features on the coring tool 100 between the core bit 102 and the stabilizer 126). For example, the outer barrel 122 may be the first section of the drill string 101 attached to the core bit 102. In some embodiments, a shank 130 may be used to attach the core bit 102 to the outer barrel 122. The stabilizer 126 may be said to be longitudinally adjacent to the core bit 102. Thus, there may not be any additional drill string sections (e.g., subs) between the outer barrel 122 on which the stabilizer 126 is located and the core bit 102.

Figure 2:
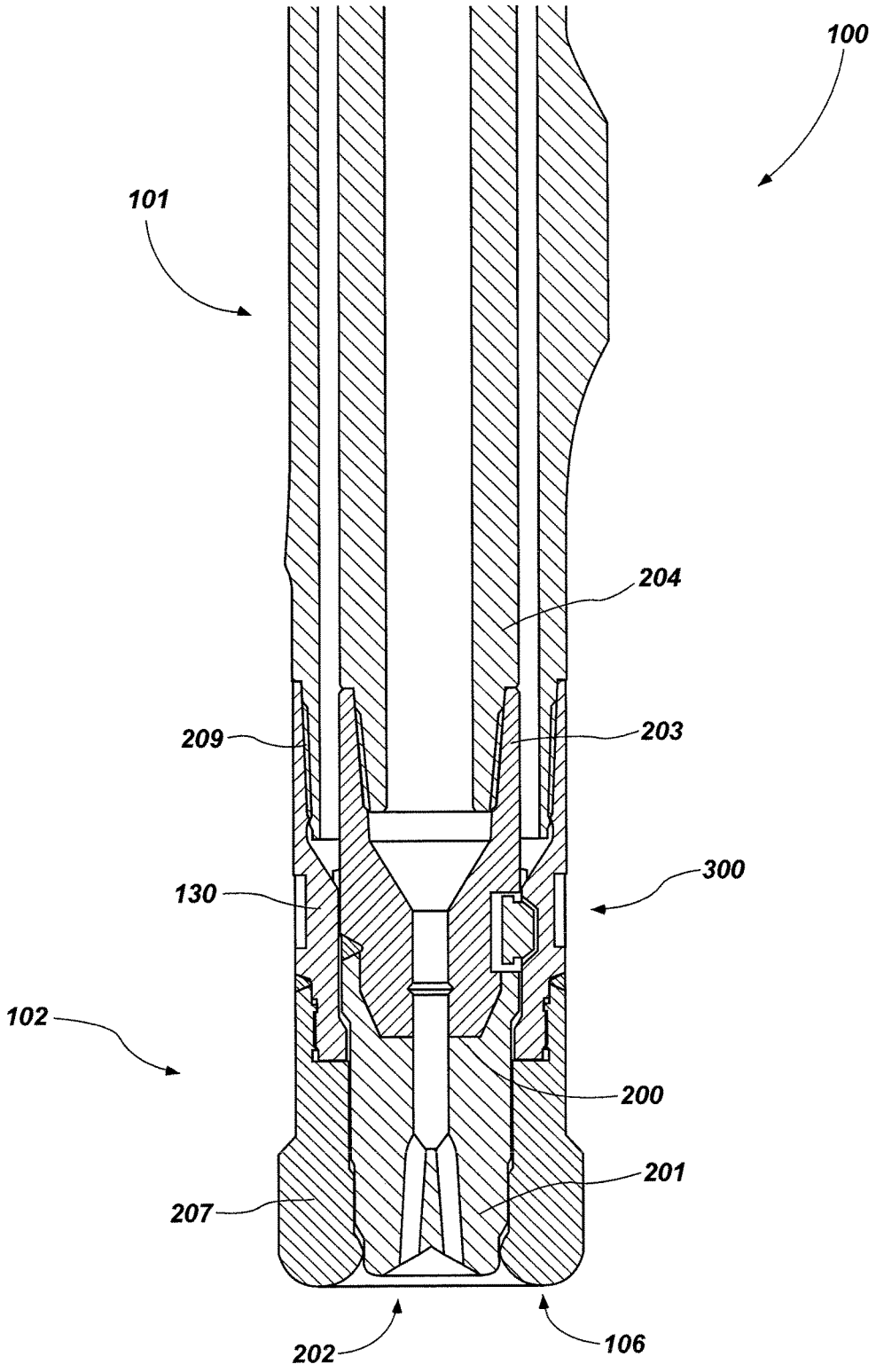
FIG. 2 is a cross-sectional view of an embodiment of a coring tool with a drill plug and an indexing device of the present disclosure.

In some situations, it may be desirable to alternate between coring operations and conventional drilling operations without necessitating the costly and time-consuming step of tripping (i.e., removing) the drill string 101 from the well bore 156. Accordingly, receptacle 114 may be removable from the core bit 102 (e.g., by a wireline device), and a drill plug may be inserted into the central opening 112 of the core bit (e.g., also by a wireline device). Referring now to FIG. 2, coring tool 100 may include a drill plug 200 with an outer diameter corresponding generally to the diameter of the central opening 112 (FIG. 1) of the core bit 102. When the drill plug 200 is inserted in the core bit 102, the drill plug 200 may close the central opening 112 into which the core sample 154 (FIG. 1) is received during coring, and a first portion 201 of the drill plug 200 may include a drilling face 202 exposed to the earth formation. When the drill plug 200 is inserted into the core bit 102, the drilling face 202 of the first portion 201 of the drill plug 200 and the face 106 of the core bit 102 may, in combination, form a substantially continuous drilling surface. The drill plug 200 may also include a second portion 203 longitudinally adjacent and above the first portion 201. The second portion 203 of the drill plug 200 may be configured to interact with a wireline device 204 to enable the drill plug 200 to be inserted or retrieved from the core bit 102 by wireline without "tripping" the drill string 101.

In some aspects of the present disclosure, the first portion 201 and the second portion 203 of the drill plug 200 may comprise two or more separate components, and the two or more separate components may be formed from different materials. For example, the first portion 201 of the drill plug 200 including the drilling face 202 may be formed from a material highly resistant to abrasion, such as a composite material including tungsten carbide particles suspended in a continuous metal alloy, such as bronze or steel. The second portion 203 (e.g., a shank) of the drill plug 200 may be formed from a different material, such as steel. Material of the second portion 203 may be chosen based on ease of manufacturing and machining, so that the second portion 203 may be more easily formed and affixed or connected to the wireline device 204. The first portion 201 and the second portion 203 may be affixed to one another by brazing, mechanical fasteners, an interference fit (e.g., wherein a portion of a matrix material of the first portion 201 is placed in compression by a portion of steel of the second portion 203), threads, or other methods.

Similarly, the core bit 102 may include two or more separate portions. For example, the core bit 102 may include a bit body 207 cast or sintered from a material suitable for use in a downhole environment, such as a cemented tungsten carbide composite material. The core bit 102 may also include a shank 130. The shank 130 may be made from a material different from the material of the bit body 207. For example, the shank 130 may be made from a material with good machinability, such as steel, and may include features such as a tool joint (e.g., threaded box member 209) for connecting the core bit 102 to the drill string 101. The bit body 207 and the shank 130 may be attached together by brazing or other suitable methods to create a bit body of the core bit 102.

The drill plug 200 may include an indexing device 300. The indexing device 300 may be configured to establish a fixed angular relationship between the core bit 102 and the drill plug 200 when the drill plug 200 is inserted into the core bit 102 and the indexing mechanism 300 is engaged. For example, when the drill plug 200 is fully inserted into the core bit 102, the indexing device 300 may prevent relative rotational movement between the core bit 102 and the drill plug 200. In some embodiments of the present disclosure, the indexing device 300 may allow the drill plug 200 to be completely inserted into the core bit 102 in any angular orientation, and the indexing device 300 may engage only when the core bit 102 and the drill plug 200 are rotated relative to one another to reach a predetermined angular relationship. In other embodiments, the indexing device 300 may prevent the drill plug 200 from being fully inserted into the core bit 102 before a predetermined angular relationship between the core bit 102 and the drill plug 200 is established.

Figure 3:
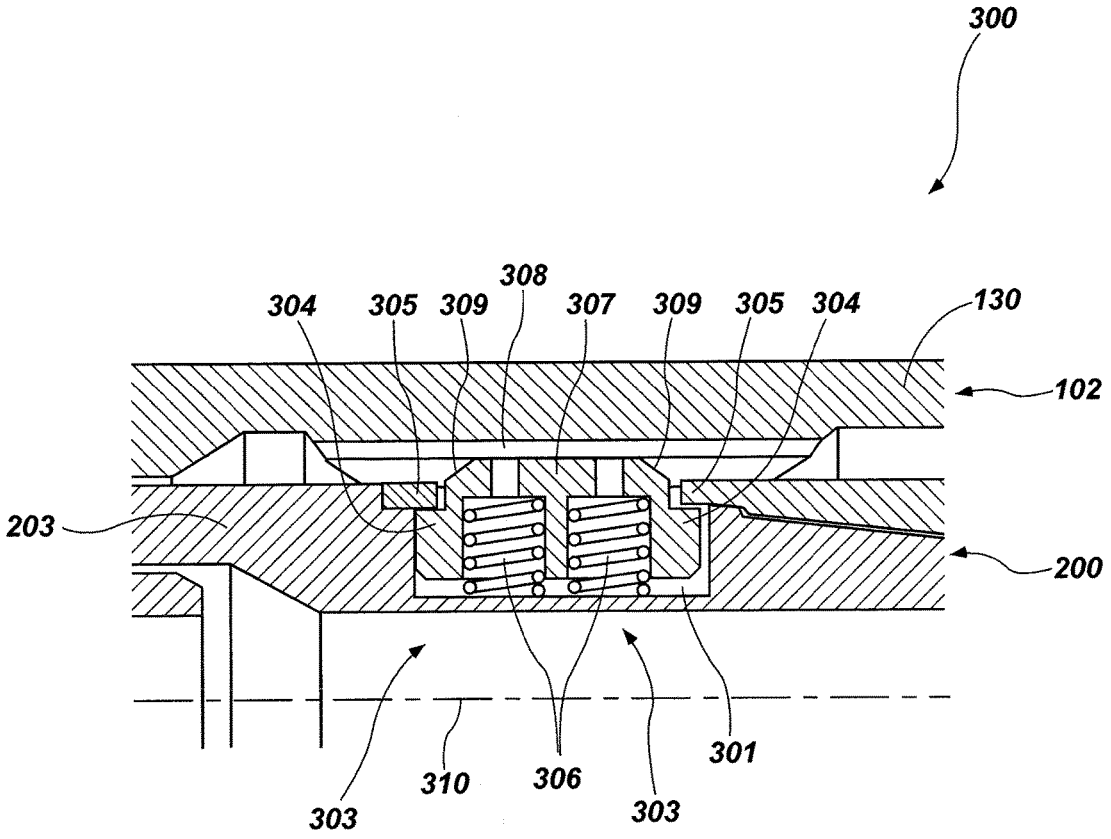
FIG. 3 is an enlarged cross-sectional view of the indexing device of the coring tool according to the embodiment of FIG. 2.

Referring now to FIG. 3, the indexing device 300 may include a first recess 301 disposed in the second portion 203 of the drill plug 200. A locking element 303 may be disposed within the first recess 301. Thus, the locking element 303 is disposed directly between the drill plug 200 and the core bit 102 at an interface therebetween. The locking element 303 may be free to move within the first recess 301 in a direction normal to a common longitudinal axis 310, as shown by dashed line, of the drill plug 200 and the core bit 102. The locking element 303 may include a shoulder 304 configured to rest against a flange 305 when the locking element 303 is in a fully extended position. Biasing elements 306, such as springs, may be disposed within the first recess 301 and may bias the locking element 303 in the fully extended position. The locking element 303 may also include a locking portion 307 configured to protrude from the first recess 301 in the drill plug 200 and extend at least partially into a second recess 308 formed in the inner surface 110 defining the central opening 112 (FIG. 1) of the core bit 102. The second recess 308 may be sized to receive the locking portion 307 of the locking element 303 therein. In one aspect of the present disclosure, the second recess 308 may be formed in the shank 130 of the core bit 102. In this configuration, when the locking element 303 of the drill plug 200 extends into the second recess 308 in the core bit 102, mechanical interference between the drill plug 200, the locking element 303, and the core bit 102 precludes relative rotational movement between the drill plug 200 and the core bit 102.

The indexing device 300 may be configured to permit relative longitudinal movement between the core bit 102 and the drill plug 200 while simultaneously preventing relative rotational movement therebetween. For example, longitudinal ends of the locking element 303 may feature inclined portions 309 oriented at acute angles to the longitudinal axis 310 of the core bit 102 and the drill plug 200. When longitudinal movement of the drill plug 200 with respect to the core bit 102 is initiated, such as when removing the drill plug 200 from the core bit 102 by wireline device 204 (FIG. 2), one of the inclined portions 309 may bear against an interior end of the second recess 308, forcing the locking portion 307 into the first recess 301 against the force of the biasing elements 306, thus allowing the drill plug 200 to be removed from the core bit 102.

When it is desired to cease coring operations and begin drilling, the coring receptacle 114 (FIG. 1) may be retrieved from the core bit 102 and bottom-hole assembly (BHA) by wireline device 204 (FIG. 2). The drill plug 200 may then be lowered, also by wireline device 204, through the bottom-hole assembly and into the inner diameter 112 of the core bit 102 (FIG. 1). The drill plug 200 may then be rotated with respect to the core bit 102 (e.g., by rotating the drill string 101 and the core bit 102 while the drill plug 200 remains stationary) until the locking element 303 aligns with the second recess 308 and the biasing elements 306 forces the locking portion 307 into the second recess 308, thereby fixing the angular relationship between the drill plug 200 and the core bit 102. Continued rotation of the core bit 102 will also result in synchronous rotation of the drill plug 200 with the core bit 102 while drill plug 200 and core bit 102 remain in a predetermined, fixed relative rotational relationship therebetween.

The indexing device 300 may be positioned directly between the core bit 102 and the drill plug 200 at an interface therebetween to minimize angular misalignment of the face 106 of the core bit 102 relative to a face of the drill plug 200. In previously known coring tools, rotational locking between a drill plug and a core bit was achieved at a location remote from an interface between the core bit and the drill plug at a location vertically above the core bit. As a result, angular misalignment often occurred between the core bit and the drill plug due to rotational strain of the components below a locking device, and due to limited movement at joints between tool components below the locking device. In one aspect of the present disclosure, the second recess 308 may be formed in the shank 130 of the core bit 102.

During drilling and coring operations, torque and weight-on-bit (WOB) may be applied to the core bit 102 through the drill string 101 (FIG. 1) to advance the core bit 102 through the formation. The configuration and the material of the components of the indexing device 300 may be chosen to provide sufficient strength to transfer torque from the core bit 102 to the drill plug 200 as the core bit 102 rotates and advances through the formation. Although the foregoing figures and description refer to a single locking element 303, the present disclosure is not so limited. For example, in some aspects of the disclosure, the indexing device 300 may include multiple locking elements 303 to increase the total strength and torque capacity of the indexing device 300.

In other aspects of the present disclosure, the indexing device 300 may include geometric features disposed on a lateral side surface of drill plug 200 and corresponding, complementary and interlocking geometric features disposed on the inner surface 110 of the core bit 102 within the central opening 112 of the core bit 102. The geometric features on the lateral side surface of the drill plug 200 may be configured to interlock with the geometric features on the inner surface 110 in the central opening 112 of the core bit 102 in a manner that permits the drill plug 200 to be inserted into or removed from the central opening 112 of the core bit 102 in a longitudinal direction while preventing any relative rotational movement between the drill plug 200 and the core bit 102.

Figure 4A:
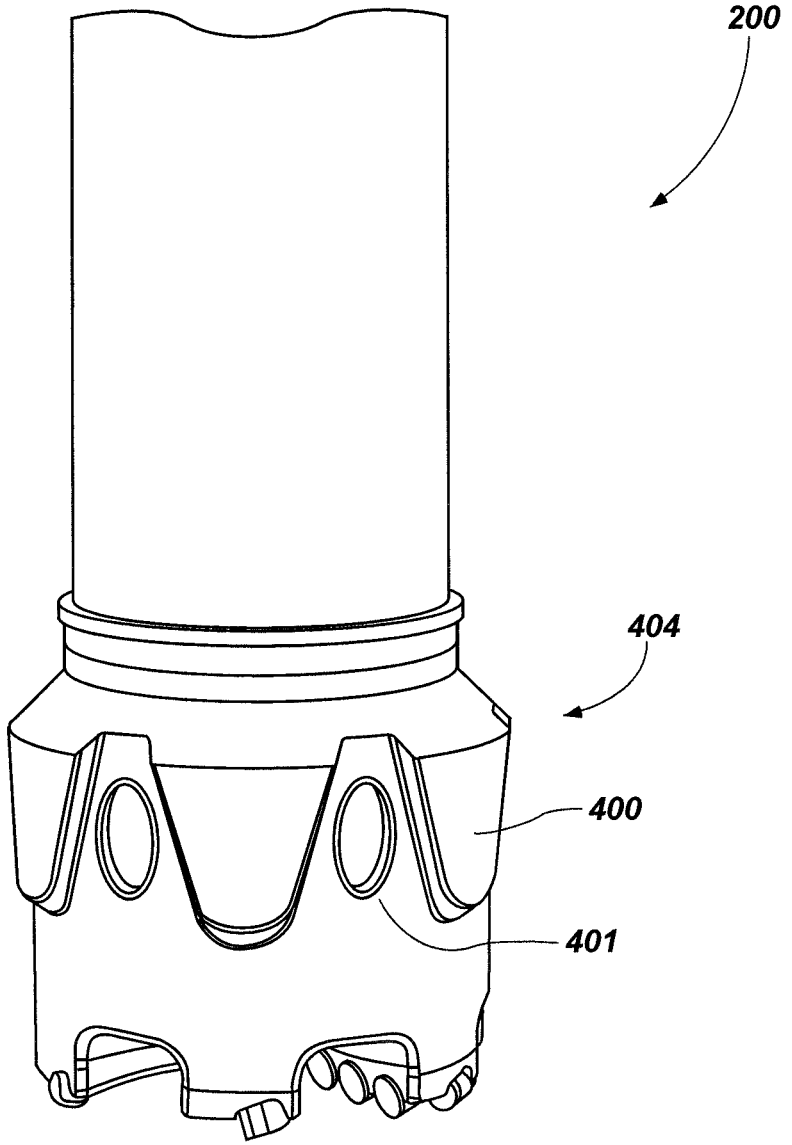
FIG. 4A is a perspective view of a drill plug according to an embodiment of the present disclosure.
Figure 4B:
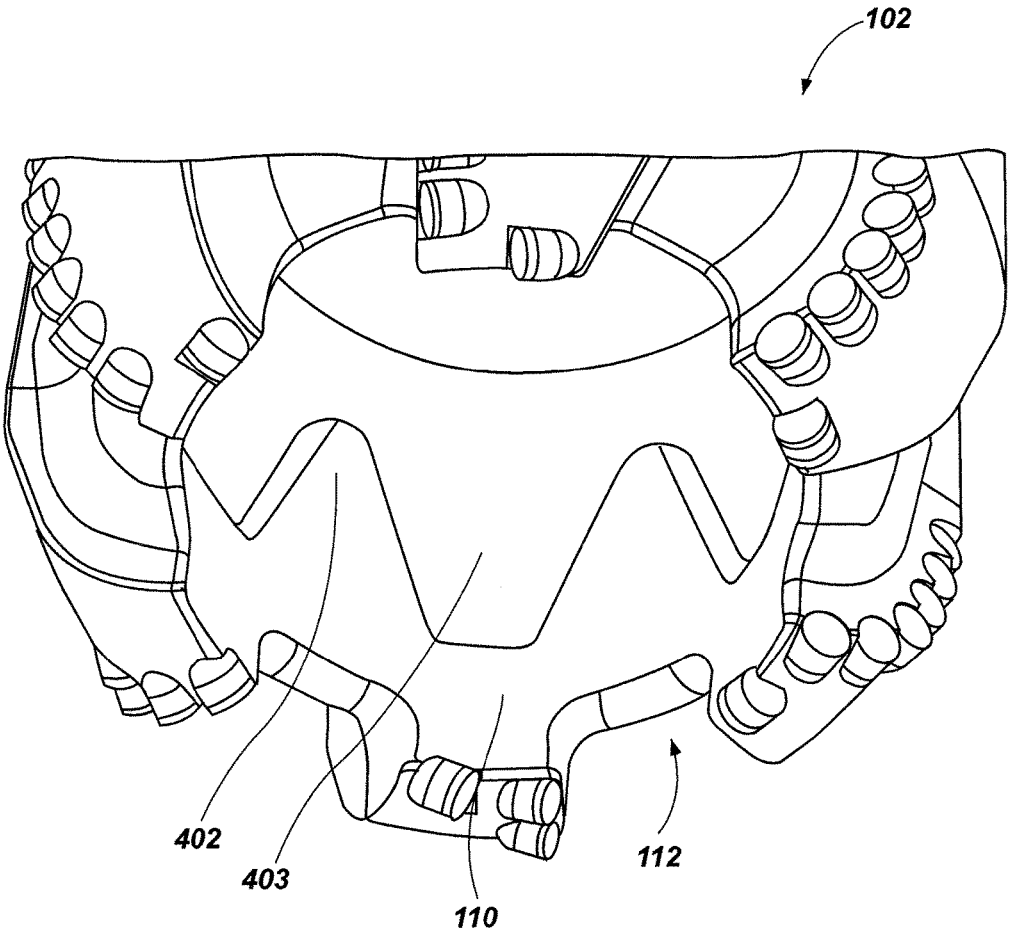
FIG. 4B is an enlarged partial perspective view of a core bit corresponding to the drill plug of the embodiment of FIG. 4A.

For example, referring now to FIG. 4A, the drill plug 200 may include a pattern of alternating, generally triangular protrusions 400 and recesses 401 disposed on an outer diameter 404. As shown in FIG. 4B, the inner surface 110 of the core bit 102 within the central opening 112 may include a similar pattern of protrusions 402 and recesses 403. With reference to FIGS. 4A and 4B, the protrusions 400 on drill plug 200 may correspond to (i.e., interlock with) the recesses 403 on the inner surface 110 of the core bit 102. Likewise, the recesses 401 on the drill plug 200 may correspond to (i.e., interlock with) the protrusions 402 disposed on the inner surface 110 of the core bit 102. As the drill plug 200 is lowered into the core bit 102 from above, the protrusions 400 and 402 interlock with recesses 401 and 403 to prevent relative rotational movement between the drill plug 200 and the core bit 102. Torque may be applied to the drill string 101 (FIG. 1) and the core bit 102 and drill plug 200 may rotate together and advance through the formation synchronously with the core bit 102.

In some embodiments, the indexing device 300 including the alternating pattern of protrusions 400, 402 and recesses 401, 403, respectively, may be configured to permit full insertion of the drill plug 200 into the core bit 102 only in a predetermined angular orientation. For example, the alternating pattern of protrusions 400, 402 and recesses 401, 403 may include one or more geometrically anomalous features. The geometrically anomalous feature may be configured to permit full insertion of the drill plug 200 into the core bit 102 in only one angular orientation. For example, one of the protrusions 400 on the outer diameter 404 of the drill plug 200 may be larger than all other protrusions 400. One of the recesses 403 on the inner surface 110 of the core bit 102 may be correspondingly larger, such that the larger protrusion may only fit within the correspondingly larger recess. Thus, the drill plug 200 may not be fully inserted into the core bit 102 until the larger protrusion and larger recess are aligned, thereby placing the core bit 102 and the drill plug 200 in a predetermined angular relationship.

When it is desired to cease coring operations and begin drilling, the coring receptacle 114 (FIG. 1) may be retrieved from the core bit 102 and bottom-hole assembly by wireline device 204 (FIG. 2). The drill plug 200 may then be lowered, also by wireline device 204, through the bottom-hole assembly and into the central opening 112 (FIG. 1) of the core bit 102. As the drill plug 200 approaches the central opening 112, the core bit 102 may be rotated with respect to the drill plug 200 (e.g., by rotating the core bit 102 while the drill plug 200 remains rotationally stationary on a wireline device 204) until the drill plug 200 and the core bit 102 substantially reach a predetermined angular relationship. The drill plug 200 may then be lowered fully into the central opening 112 of the core bit 102 and the protrusions 400, 402 and recesses 401, 403 interlock to prevent relative angular movement between the core bit 102 and the drill plug 200 as the coring tool 100 rotates and advances through the formation.

Figure 5:
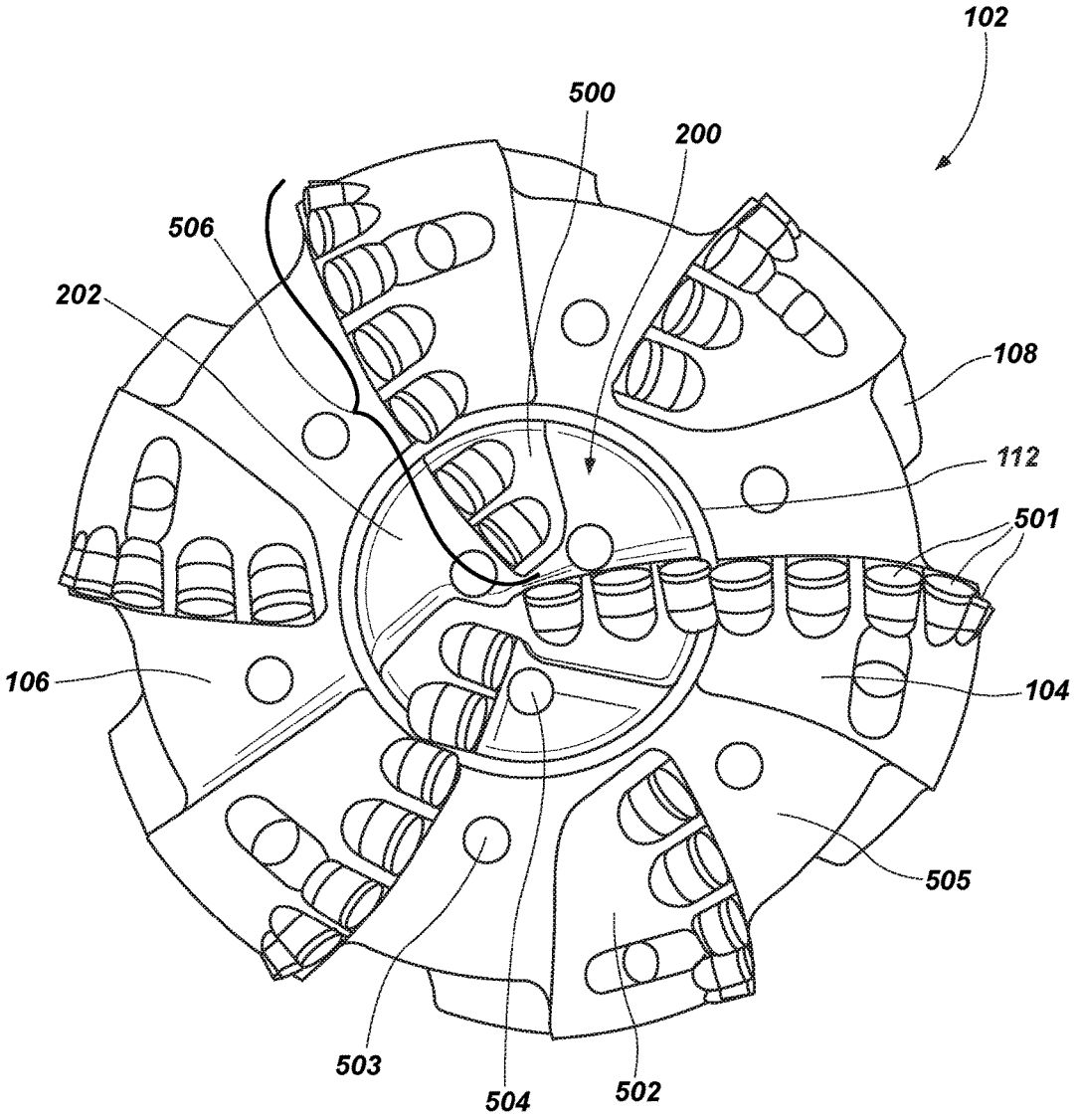
FIG. 5 is a perspective view of a core bit and drill plug according to another embodiment of the present disclosure.

Referring now to FIG. 5, the drilling face 202 of the drill plug 200 may include features configured to complement features of the core bit 102. For example, the core bit 102 may include one or more cutting structures 104 (e.g., blades) protruding from the face 106 of the core bit 102. The one or more blades 104 may extend outward from the face 106 of the core bit 102, and may follow a path extending from the central opening 112 to the outer gage 108 of the core bit 102. A plurality of hard or superabrasive material cutting elements 501 (e.g., polycrystalline diamond compacts (PDCs)) may be disposed within recesses in the one or more blades 104. The drill plug 200 may include one or more inner blades 500 disposed on the drilling face 202 of the drill plug 200. The one or more inner blades 500 may be configured to complement (i.e., function together with) the one or more blades 104 on the face 106 of the core bit 102. In one aspect of the disclosure, inner blades 500, together with blades 104 of the core bit 102, form substantially continuous cutting structures 506 (e.g., blades) that extend smoothly and continuously across the interface between the drill plug 200 and the core bit 102 when the drill plug 200 is fully inserted in the core bit 102.

The indexing mechanism 300 (FIG. 3) may be configured to engage and establish an angular relationship between the drill plug 200 and the core bit 102 based on the locations of the one or more blades 104 on the core bit 102 and the one or more inner blades 500 on the drill plug 200. For example, the indexing mechanism 300 may be configured to engage and lock when the one or more blades 104 are aligned with the one or more inner blades 500 of the drill plug 200. In some aspects of the disclosure, the face 106 of the core bit 102 may also include blades 502 that do not form substantially continuous blade structures with features on the drilling face 202 of the drill plug 200. Similarly, in some embodiments, the first end 201 (FIG. 2) of the drill plug 200 may also include one or more inner blades 500 that do not form substantially continuous structures 506 together with the one or more cutting structures 104 on the face 106 of the core bit 102.

The core bit 102 may also include fluid nozzles 503 in communication with fluid passages in the core bit 102. The fluid nozzles 503 may be configured to direct a flow of drilling fluid from the flow path 124 (FIG. 1) to provide cleaning, cooling, and lubrication to the drilling face 202 of the drill plug 200 and the face 106 of the core bit 102. Drilling fluid may flush formation chips away from cutting edges of the plurality of cutting elements 501 and may extend the life of the plurality of cutting elements 501 by providing cooling and lubrication at the cutting edges of the plurality of cutting elements 501. Similar fluid nozzles 504 may be provided in the drilling face 202 of the drill plug 200. The fluid nozzles 504 in the drilling face 202 of the drill plug 200 may be configured to provide a flow of drilling fluid to the plurality of cutting elements 501 disposed on the one or more inner blades 500 of the drilling face 202 or to the one or more blades 104 disposed on the core bit 102. The fluid nozzles 504 in the drill plug 200 and the fluid nozzles 503 in the surface 106 of the core bit 102 may be configured to provide a combined flow of drilling fluid that sufficiently cleans, cools, and lubricates the plurality of cutting elements 501.

In some embodiments of the present disclosure, the predetermined angular relationship between the core bit 102 and the drill plug 200 may include a single angular relationship. In other embodiments, the predetermined angular relationship may include multiple angular relationships. Accordingly, features of the core bit 102 and the drill plug 200 may be configured to align at multiple angles, such as every one hundred twenty (120) degrees of relative rotation between the core bit 102 and drill plug 200. For example, features of the core bit 102 and the drill plug 200 may include three blades spaced equidistantly around a rotational axis of the core bit 102 and configured to form substantially continuous blades in any of three angular orientations one hundred twenty (120) degrees apart.

The blades 104 and inner blades 500 may be configured with fluid courses 505 (i.e., spaces) therebetween in which formation chips dislodged by cutting elements 501 can collect to be swept away by the flow of drilling fluid. The fluid courses 505 may begin near a center of the drilling face 202 of the drill plug 200 and extend along the surface of the core bit 102 to the outer gage 108.

In another aspect of the present disclosure, a method of drilling with a coring tool may comprise removing a core sample receptacle from an inner bore of a core bit with a wireline device, inserting a drill plug into the inner bore of the core bit with a wireline device, rotating the drill plug relative to the core bit to reach a predetermined angular relationship, and drilling through a formation with the core bit and drill plug. The method of drilling with a coring tool may include rotating the drill plug relative to the core bit to reach the predetermined angular relationship subsequent to inserting the drill plug into the inner bore of the core bit. The method of drilling with a coring tool may include inserting the drill plug into the inner bore of the core bit subsequent to rotating the drill plug relative to the core bit to reach the predetermined angular relationship. The method of drilling with a coring tool may include removing the drill plug from the inner bore of the core bit with a wireline device subsequent to drilling. The method of drilling with a coring tool may also comprise reinserting the core sample receptacle into the inner bore of the core bit with a wireline device subsequent to removing the drill plug.

Additional, non-limiting embodiments within the scope of this disclosure include:

Embodiment 1

A coring tool, comprising: a core bit comprising at least one cutting structure extending from adjacent an inner bore of the core bit to an outer gage of the core bit; a drill plug configured to close the inner bore of the core bit, the drill plug comprising at least one cutting structure; and an indexing device disposed between the drill plug and the core bit, the indexing device configured to maintain a predetermined angular relationship between the core bit and the drill plug, wherein the at least one cutting structure of the core bit and the at least one cutting structure of the drill plug form a substantially continuous cutting structure at the predetermined angular relationship.

Embodiment 2

The coring tool of Embodiment 1, wherein the indexing device comprises a movable locking element disposed in a recess of the drill plug, the movable locking element comprising a protruding portion corresponding to a recess in the inner bore of the core bit, the indexing device comprising at least one biasing element configured to urge the protruding portion of the movable locking element into the recess in the inner bore of the core bit.

Embodiment 3

The coring tool of Embodiments 1 or 2, wherein the indexing device comprises at least one geometric feature disposed on an outer diameter of the drill plug and at least one corresponding geometric feature disposed on an inner diameter of the core bit, the corresponding geometric features configured to interlock to maintain the predetermined angular relationship between the core bit and the drill plug.

Embodiment 4

The coring tool of Embodiment 3, wherein the at least one geometric feature disposed on the outer diameter of the drill plug and the at least one geometric feature disposed on the inner diameter of the core bit comprise a pattern of alternating recesses and protrusions.

Embodiment 5

The coring tool of Embodiment 4, wherein the pattern of alternating recesses and protrusions comprises an anomalous recess and a corresponding anomalous protrusion.

Embodiment 6

The coring tool of any one of Embodiments 1 through 5, wherein the core bit comprises a shank and the indexing device is disposed between the drill plug and the shank of the core bit.

Embodiment 7

The coring tool of any one of Embodiments 1 through 6, wherein the at least one cutting structure of the core bit comprises a blade with a plurality of hard material cutting elements mounted on the blade.

Embodiment 8

The coring tool of any one of Embodiments 1 through 7, wherein the at least one cutting structure of the drill plug comprises a blade with at least one hard material cutting element mounted on the blade of the drill plug.

Embodiment 9

The coring tool of any one of Embodiments 1 through 8, wherein the predetermined angular relationship comprises a single angular orientation between the core bit and the drill plug.

Embodiment 10

The coring tool of any one of Embodiments 1 through 8, wherein the predetermined angular relationship comprises two or more angular orientations between the core bit and the drill plug.

Embodiment 11

A coring tool, comprising: a core bit with an inner bore extending longitudinally through a body of the core bit; a coupling member configured for attachment of the coring tool to a drill string; a drill plug sized and configured to be inserted into the inner bore of the core bit; and an indexing device configured to maintain a predetermined angular relationship between the core bit and the drill plug, the indexing device disposed between the core bit and the drill plug and located longitudinally along the coring tool at a location distal to the coupling member of the coring tool.

Embodiment 12

The coring tool of Embodiment 11, wherein the core bit and the drill plug comprise complementary cutting structures, the complementary cutting structures together forming a substantially continuous cutting structure at the predetermined angular relationship between the core bit and the drill plug.

Embodiment 13

The coring tool of Embodiments 11 or 12, wherein the substantially continuous cutting structure comprises: a blade extending over at least a portion of the drill plug and at least a portion of the core bit; and a plurality of cutting elements mounted on the blade.

Embodiment 14

The coring tool of any one of Embodiments 11 through 13, wherein the indexing device is disposed between the drill plug and a shank of the core bit.

Embodiment 15

The coring tool of any one of Embodiments 11 through 14, wherein the indexing device is disposed at least partially in a shank of the drill plug.

Embodiment 16

A method of drilling with a coring tool, comprising: removing a core sample receptacle from an inner bore of a core bit; inserting a drill plug into the inner bore of the core bit; rotating the drill plug relative to the core bit to reach a predetermined angular relationship; rotationally locking the drill plug relative to the core bit at the predetermined angular relationship; and drilling through a formation with the core bit and drill plug.

Embodiment 17

The method of Embodiment 16, further comprising rotating the drill plug relative to the core bit to reach the predetermined angular relationship subsequent to inserting the drill plug into the inner bore of the core bit.

Embodiment 18

The method of Embodiment 16, further comprising inserting the drill plug into the inner bore of the core bit subsequent to rotating the drill plug relative to the core bit to reach the predetermined angular relationship.

Embodiment 19

The method of any one of Embodiments 16 through 18, further comprising removing the drill plug from the inner bore of the core bit subsequent to drilling without removing the coring tool from a wellbore formed by the drilling.

Embodiment 20

The method of any one of Embodiments 16 through 19, further comprising reinserting the core sample receptacle into the inner bore of the core bit subsequent to removing the drill plug without removing the coring tool from the wellbore.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventors.

What is claimed is:

1. A coring tool, comprising:

a core bit comprising at least one cutting structure extending from adjacent an inner bore of the core bit to an outer gage of the core bit;

a drill plug configured to close the inner bore of the core bit, the drill plug comprising at least one cutting structure; and an indexing device disposed between the drill plug and the core bit, the indexing device configured to maintain a singular predetermined angular relationship between the core bit and the drill plug by the presence of a movable locking element movable between an extended position and a retracted position, the movable locking element biased toward the extended position, wherein the at least one cutting structure of the core bit and the at least one cutting structure of the drill plug form a substantially continuous cutting structure when the drill plug is located within the inner bore of the core bit at the singular predetermined angular relationship such that an exposed outer surface of the drill plug is at least substantially flush with an exposed outer surface of the core bit proximate the inner bore and the movable locking element is in the extended position, and wherein the at least one cutting structure of the core bit and the at least one cutting structure of the drill plug would form a discontinuous cutting structure if the drill plug were located within the inner bore of the core bit angularly misaligned from the singular predetermined angular relationship such that only a portion of the exposed outer surface of the drill plug was at least substantially flush with the exposed outer surface of the core bit proximate the inner bore, and the movable locking element were in the retracted position.

2. The coring tool of claim 1, wherein the movable locking element is disposed in a recess of the drill plug, the movable locking element comprising a protruding portion corresponding to a recess in the inner bore of the core bit, the indexing device comprising at least one biasing element configured to urge the protruding portion of the movable locking element into the recess in the inner bore of the core bit.

3. The coring tool of claim 1, wherein the core bit comprises a shank and the indexing device is disposed between the drill plug and the shank of the core bit.

4. The coring tool of claim 1, wherein the at least one cutting structure of the core bit comprises a blade with a plurality of hard material cutting elements mounted on the blade.

5. The coring tool of claim 1, wherein the at least one cutting structure of the drill plug comprises a blade with at least one hard material cutting element mounted on the blade of the drill plug.

6. The coring tool of claim 1, wherein the predetermined angular relationship comprises two or more angular orientations between the core bit and the drill plug.

7. A coring tool, comprising:

a core bit with an inner bore extending longitudinally through a body of the core bit and at least one cutting structure at a longitudinal end of the core bit;

a coupling member configured for attachment of the coring tool to a drill string;

a drill plug sized and configured to be inserted into the inner bore of the core bit, the drill plug comprising at least one cutting structure; and an indexing device configured to maintain a singular predetermined angular relationship between the core bit and the drill plug by the presence of a movable locking element movable between an extended position and a retracted position, the movable locking element biased toward the extended position, the indexing device disposed between the core bit and the drill plug and located longitudinally along the coring tool at a location distal to the coupling member of the coring tool, wherein the at least one cutting structure of the core bit and the at least one cutting structure of the drill plug form a substantially continuous cutting structure when the drill plug is located within the inner bore of the core bit at the singular predetermined angular relationship such that an exposed outer surface of the drill plug is at least substantially flush with an exposed outer surface of the core bit proximate the inner bore and the movable locking element is in the extended position, and wherein the at least one cutting structure of the core bit and the at least one cutting structure of the drill plug would form a discontinuous cutting structure if the drill plug were located within the inner bore of the core bit angularly misaligned from the singular predetermined angular relationship such that only a portion of the exposed outer surface of the drill plug was at least substantially flush with the exposed outer surface of the core bit proximate the inner bore, and the movable locking element were in the retracted position.

8. The coring tool of claim 7, wherein the substantially continuous cutting structure comprises:

a blade extending over at least a portion of the drill plug and at least a portion of the core bit; and a plurality of cutting elements mounted on the blade.

9. The coring tool of claim 7, wherein the indexing device is disposed between the drill plug and a shank of the core bit.

10. The coring tool of claim 7, wherein the indexing device is disposed at least partially in a shank of the drill plug.

11. A method of drilling with a coring tool, comprising:

removing a core sample receptacle from an inner bore of a core bit;

inserting a drill plug into the inner bore of the core bit such that an exposed outer surface of the drill plug is at least substantially flush with an exposed outer surface of the core bit proximate the inner bore;

rotating the drill plug relative to the core bit to reach a singular predetermined angular relationship; wherein at least one cutting structure of the core bit and at least one cutting structure of the drill plug form a substantially continuous cutting structure at the singular predetermined angular relationship and wherein the at least one cutting structure of the core hit and the at least one cutting structure of the drill plug would form a discontinuous cutting structure if the drill plug were located within the inner bore of the core bit rotationally misaligned from the singular predetermined angular relationship such that only a portion of the exposed outer surface of the drill plug was at least substantially flush with the exposed outer surface of the core bit proximate the inner bore;

rotationally locking the drill plug relative to the core bit at the singular predetermined angular relationship by the presence of a movable locking element movable between an extended position and a retracted position, the movable locking element biased toward the extended position; and drilling through a formation with the core bit and drill plug.

12. The method of claim 11, further comprising rotating the drill plug relative to the core bit to reach the predetermined angular relationship subsequent to inserting the drill plug into the inner bore of the core bit.

13. The method of claim 11, further comprising inserting the drill plug into the inner bore of the core bit subsequent to rotating the drill plug relative to the core bit to reach the predetermined angular relationship.

14. The method of claim 11, further comprising removing the drill plug from the inner bore of the core bit subsequent to drilling without removing the coring tool from a wellbore formed by the drilling.

15. The method of claim 14, further comprising reinserting the core sample receptacle into the inner bore of the core bit subsequent to removing the drill plug without removing the coring tool from the wellbore.

* * * * *